US011745380B2

(12) United States Patent
Dereims

(10) Patent No.: US 11,745,380 B2
(45) Date of Patent: Sep. 5, 2023

(54) MOBILE POINT DEVICE FOR SENSING A HIGH-PRESSURE WATERJET COMING OUT OF A NOZZLE OF A CUTTING MACHINE

(71) Applicant: HYDROPROCESS, Chalon sur Saone (FR)

(72) Inventor: Philippe Dereims, Chalon sur Saone (FR)

(73) Assignee: HYDROPROCESS, Chalon sur Saone (FR)

( * ) Notice: Subject to any disclaimer, the term of this patent is extended or adjusted under 35 U.S.C. 154(b) by 0 days.

(21) Appl. No.: 17/772,408

(22) PCT Filed: Nov. 19, 2020

(86) PCT No.: PCT/EP2020/082740
§ 371 (c)(1),
(2) Date: Apr. 27, 2022

(87) PCT Pub. No.: WO2021/099496
PCT Pub. Date: May 27, 2021

(65) Prior Publication Data

US 2022/0371217 A1 Nov. 24, 2022

(30) Foreign Application Priority Data

Nov. 22, 2019 (FR) ..... 1913073

(51) Int. Cl.
*B26F 3/00* (2006.01)

(52) U.S. Cl.
CPC ..... *B26F 3/008* (2013.01)

(58) Field of Classification Search
CPC ..... B26F 3/008
(Continued)

(56) References Cited

U.S. PATENT DOCUMENTS 5,111,652 A * 5/1992 Andre ..... B26F 3/008 451/87
5,782,673 A * 7/1998 Warehime ..... B24C 5/02 451/36

(Continued)

FOREIGN PATENT DOCUMENTS

DE 102010019707 A1 11/2011
FR 2528994 A1 12/1983

OTHER PUBLICATIONS

International Search Report (with English translation) and Written Opinion (with Machine translation) dated Mar. 3, 2021 in corresponding International Application No. PCT/EP2020/082740, 13 pages.

*Primary Examiner* — Omar Flores Sanchez
(74) *Attorney, Agent, or Firm* — Maier & Maier, PLLC

(57) ABSTRACT

A device incorporated into a waterjet cutting machine provided with at least one receiving tank and a movable nozzle, the device being capable of sensing a high-pressure waterjet coming out of the nozzle and including a movable receptacle arranged inside the receiving tank in line with the nozzle, the lower portion of the receptacle being connected to a flexible pipe connected to the bottom of the receiving tank, and—a drive for supporting and moving at least part of the receptacle including the pipe assembly, the drive including a driving member rigidly connected to the nozzle, and a driven member attached to the receptacle, the driving member and the driven member not being mechanically connected.

10 Claims, 1 Drawing Sheet

(58) Field of Classification Search
USPC ..... 83/177
See application file for complete search history.

(56) References Cited

U.S. PATENT DOCUMENTS

| | | | | |
|---|---|---|---|---|
| 2005/0079797 | A1* | 4/2005 | Marti | B24C 3/18 451/65 |
| 2012/0297943 | A1* | 11/2012 | Grosbois | B29C 70/545 83/15 |
| 2014/0165807 | A1* | 6/2014 | David | B26F 3/004 83/177 |
| 2015/0298343 | A1* | 10/2015 | Jung | B26F 3/008 83/34 |
| 2018/0001507 | A1* | 1/2018 | Dereims | B26F 1/26 |
| 2022/0305599 | A1* | 9/2022 | Dereims | B26D 5/00 |

* cited by examiner

[Fig. 1]
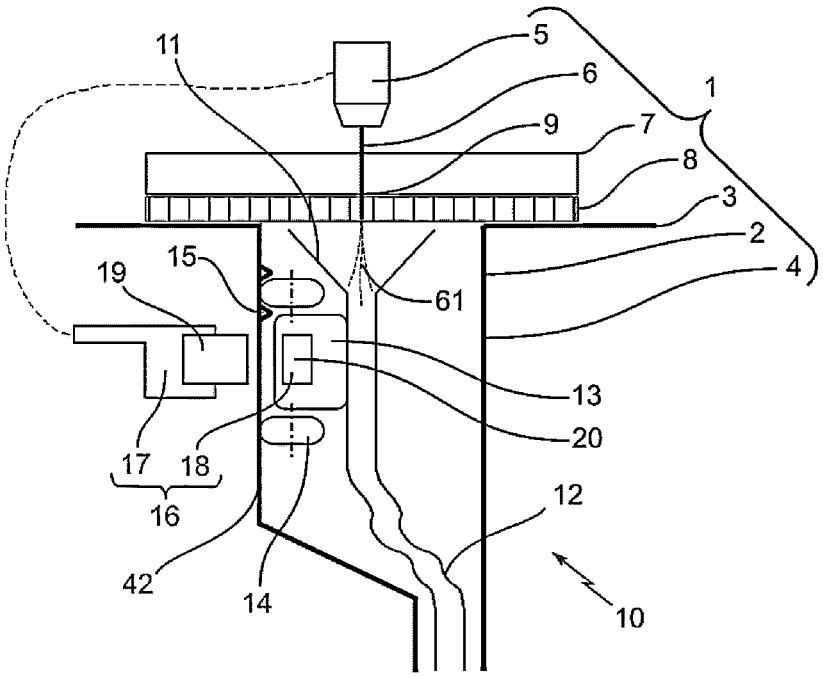
[Fig. 2]
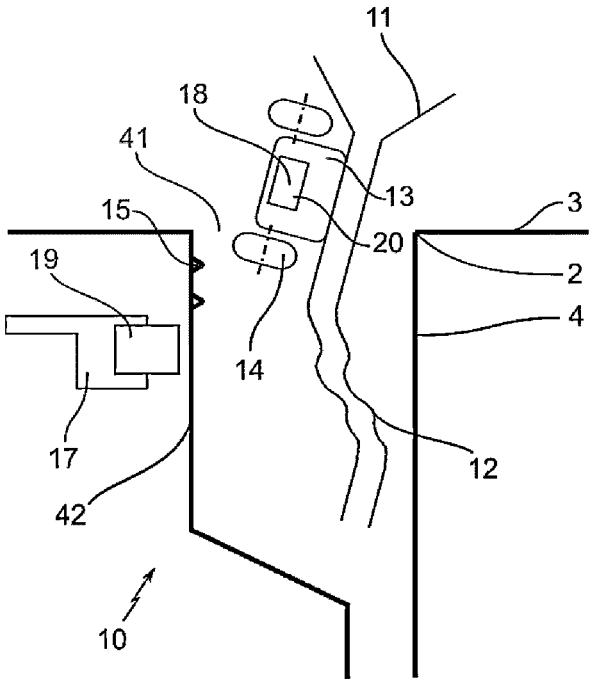

MOBILE POINT DEVICE FOR SENSING A HIGH-PRESSURE WATERJET COMING OUT OF A NOZZLE OF A CUTTING MACHINE

TECHNICAL FIELD

The present invention relates to the general field of waterjet cutting machines for food products, and more particularly to a device, commonly referred to as a "catcher", which is capable of catching the water jet at the outlet of the cut food product and is arranged below the nozzle of a waterjet cutting machine.

BACKGROUND

In the field of cutting food products waterjet cutting machines are well known which consist of a frame, on which a loading tray is mounted, which may be mobile or not mobile, in the form of a grid and supports the food products to be cut, and a mobile cutting head formed by a nozzle and connected either to a carriage that moves in a longitudinal or transverse translational movement or to the free end of an arm pivoting about a vertical axis above said tray; said carriage or arm being driven by electric motors or the like. During the cutting process, the water jet traverses the product to be cut and is caught by a container, commonly referred to as a "catcher". This catcher is positioned in line with the nozzle and extends typically along the trajectory of the latter so as to be able to catch the water jet at the outlet of the cutting zone of the product to be cut, regardless of the position of said nozzle. Said catcher advantageously includes an elongated chute open on the side of the nozzle, integral with the frame and connected at the bottom to a pump for evacuating water at the outlet of the cutting zone.

Waterjet cutting machines as described in French patent application FR 2 528 994 and German patent application DE 102010019707 are also known.

Although they are relatively effective, these types of catchers and waterjet cutting machines have the following numerous disadvantages.

Firstly, the impact of pressurised and moving water jets against the surfaces of this type of catcher generates noise, the sound level of which is such that it is necessary to treat the equipment acoustically.

Furthermore, in the cutting zone this impact from the water jets creates a cloud of water droplets and particles from the cut food product which get lodged in the sliding mechanisms of the loading tray, on the guiding profiles of the carriage and on the electric motors which become home to mould and bacteria; this has a very negative effect on the overall hygiene of the cutting machine and thus requires said machine to be cleaned frequently and an additional suction device to be installed in order to limit the effect of the cloud of water droplets.

Lastly, it is recognised that it is not very easy to clean this type of catcher in the form of an elongated chute.

SUMMARY

The aim of the present invention is therefore to propose a device for catching a water jet emerging from the cutting zone of an object cut by a waterjet cutting machine which has a simple design, is easy to use and clean and at the same time guarantees an optimal result, i.e. a clean cut without excessive humidity of the cut object, the device generating noise but without the noise level being too excessive.

According to the invention, a device is proposed which is integrated into a waterjet cutting machine provided with at least one receiving tank and a mobile nozzle above said receiving tank, said device making it possible to catch a high-pressure water jet coming from said nozzle and being remarkable in that it includes at least:

- a receptacle arranged inside the receiving tank in line with said nozzle, said receptacle being connected at the bottom to a flexible pipe assembly connected to the bottom of said receiving tank, the receptacle/pipe assembly being mobile and removable with respect to the receiving tank, and
- drive means for supporting and setting in motion at least partly the receptacle/pipe assembly, including a driving member arranged outside the receiving tank and joined to the nozzle, and a driven member arranged inside the receiving tank and fixed to the receptacle, the driving means being such that there is no mechanical connection between the driving member and the driven member, at least one of the driving or driven members including a magnet.

The driving and driven members each preferably include a magnet, such that when the driving member moves at the same time as the nozzle, the magnetic force of attraction of its magnet attracts the magnet of the driven member and causes the movement of the latter and of the receptacle/pipe assembly.

The receptacle is advantageously in the form of a funnel.

Advantageously, said device includes a carriage fixed to the receptacle and cooperating with a guide profile fixed horizontally to one of the walls of the receiving tank, such that the receptacle/pipe assembly moves along said guide profile.

The carriage preferably includes at least one roller.

The wall of the receiving tank and the associated guide profile each have a cross-section with a homothetic form to that of the nozzle trajectory.

According to one embodiment the guide profile is straight.

According to another embodiment the guide profile is arcuate.

Advantageously, the pipe assembly is connected to the bottom of said receiving tank by means of a quick connect coupling that does not require the use of tools.

BRIEF DESCRIPTION OF THE FIGURES

Other advantages and features are given in the following description of an embodiment of the invention, with reference to the accompanying figures in which:

FIG. 1 is a schematic cross-sectional view of a device according to the invention for catching a jet of water coming from the cutting zone of an object cut by a waterjet cutting machine in operation, FIG. 2 is a schematic cross-sectional view of the device for catching a water jet of FIG. 1 at the time of its extraction so that it can be cleaned outside of the cutting machine.

DETAILED DESCRIPTION

FIGS. 1 to 2 represent a partial schematic representation of:

- a waterjet cutting machine 1 including in particular a frame 2 comprising in particular a horizontal installation plane 3 and a receiving tank 4 extending below said installation plane 3 and including at least one upper opening 41 and a generally vertical wall 42, and a nozzle 5 from which a high-pressure water jet 6 emerges and which is arranged above said installation plane 3 and is mobile in a trajectory which is advantageously straight or arcuate above said receiving tank 4, i.e. the receiving tank 4 extends horizontally to cover a surface containing at least the projection of the trajectory of said nozzle 5, an object 7 to be cut resting on the installation plane 3 of the frame 2, usually on a grid 8, and arranged below the nozzle 5 and a device 10 for catching the water jet 6 or the portion 61 of the water jet 6 exiting the cutting zone 9 of said object 7, commonly referred to as a "catcher".

Said device 10 includes a receptacle 11 advantageously in the form of a funnel arranged below and in line with said cutting zone 9 inside the receiving tank 4 of the cutting machine 1, said receptacle 11 being connected at the bottom to a pipe assembly 12, which is advantageously flexible, connected to the bottom of said receiving tank 4, for example by means of a quick connect coupling, which is not shown, so as to allow the evacuation of cutting effluent during the cutting phase and the emptying of the receiving tank 4 at the time of cleaning. Furthermore, the receptacle 11/pipe 12 assembly is mobile and removable with respect to the receiving tank 4.

Said device 10 also includes a carriage 13 fixed to said receptacle 11 which is provided advantageously with at least one roller 14 and is capable of cooperating with a guide profile 15 fixed horizontally to the wall 42 of the receiving tank 4 of the cutting machine 1, such that the receptacle 11/pipe 12 assembly moves at least partly along said guide profile 15, the pipe assembly 12 being dimensioned to allow this movement despite its connection to the bottom of said receiving tank 4. The guide profile 15 can include for example one or more rails. The guide profile 15 can also not be attached to the wall 42 of the receiving tank 4, but can be formed directly in said wall 42 without departing from the scope of the present invention.

Advantageously, the wall 42 of the receiving tank 4 of the cutting machine 1 and the associated guide profile 15 each have a cross-section with a homothetic form to that of the trajectory of the nozzle 5. Thus, if this trajectory is a straight line then the cross-sections of the walls 42 and the guide profile 15 are straight lines parallel to said trajectory, said guide profile 15 then being straight; if this trajectory is arcuate then the cross-sections of the walls 42 and of the guide profile 15 are arcs concentric to said trajectory, said guide profile 15 then being arcuate.

In order to set in motion and support the receptacle 11/pipe 12 assembly, the device 10 further includes drive means 16 including a driving member 17 arranged outside the receiving tank 4 and connected to the nozzle 5, i.e. moving at the same time as the latter and describing a trajectory which is homothetic to that of said nozzle 5, and a driven member 18 arranged inside the receiving tank 4 and fixed to the receptacle 11 and advantageously to its associated carriage 13.

According to a preferred embodiment, the drive means 16 are such that there is no mechanical connection between the driving member 17 and the driven member 18. This configuration is of interest, as it makes it possible, on the one hand, to arrange the driving and driven members 17, 18 on either side of the wall 42 of the receiving tank 4 without having to make orifices through said wall 42, which avoids any risk of cutting effluent passing outside said receiving tank 4 and, on the other hand, it enables quick disassembly of the receptacle 11 and its pipe assembly 12 without tools.

According to an even more preferred embodiment, the driving member and driven member 17, 18 each include a magnet 19, 20 such that when the driving member 17 moves at the same time as the nozzle 5, the magnetic force of attraction of its magnet 19 attracts the magnet 20 of the driven member 18 and causes the displacement of the latter and thus of the carriage 13 and of the receptacle 11/pipe 12 assembly along the guide profile 15. This configuration is of particular interest because not only does it ensure the displacement of the receptacle 11/pipe 12 assembly, but it guarantees in a simple manner, due to the magnetic force of attraction, the support of said receptacle 11/pipe 12 assembly and its support against said guide profile 15.

However, according to one embodiment, which is not shown, either the driving member 17 or driven member 18 includes a magnet while the other driven member 18 or driving member 17 includes a part made from a material attracted by said magnet.

It is understood that with the magnetic force of attraction there will probably be a slight offset between the driving member 17 and the driven member 18, the latter being behind said driving member 17. However, this offset is an advantage for effectively catching the water jet, as the portion 61 of the water jet 6 leaving the cutting zone 9 of the cut object 7 is also offset relative to the line of the nozzle 5.

Furthermore, it is understood that the movement of the receptacle 11/pipe 12 assembly at the same time as the nozzle 5 makes it possible to considerably reduce the dimensions of said receptacle 11.

With this configuration, it is understood that the device 10 according to the invention has the following numerous advantages:

reduction of the noise level produced by the impact of pressurised water jets 6 moving against the surfaces of the receptacle 11, as the latter has reduced dimensions and the diffusion surfaces of the noise generated are also reduced, the object 7 to be cut is placed on the grid 8 and the cutting effluent is carried away naturally (without an extraction fan) by the Venturi effect due to the receptacle 11 in the form of a funnel, no need to clean an extraction fan since, as mentioned above, this equipment is no longer necessary, simplicity of the drive system, without any need for additional motors or associated cabling, excellent cleanability of the device 10 as its configuration makes it possible to isolate the driving member 18 from the drive means 16 inside the frame 2 outside the inner area of the receiving tank 4, without any mechanical member or cabling being visible in this area, simple and quick extraction outside the receiving tank 4 of the cutting machine 1 of the receptacle assembly 11, pipe assembly 12 for cleaning outside the machine by exerting a manual action for combating the magnetic force of attraction of the magnet 19 of the member driving 18 the drive means 16 (cf. FIG. 2), easy, tool-free and safe reinstallation of the receptacle 11/pipe 12 assembly inside the receiving tank 4 of the cutting machine 1 of the assembly, by bringing said receptacle 11/pipe 12 assembly in contact with the guide profile 15, by moving it to a position in line with the nozzle 5 and finally reconnecting the pipe assembly 12 to the bottom of said receiving tank 4, easy cleaning of the receiving tank 4 of the cutting machine 1 after the extraction of the receptacle 11/pipe 12 assembly.

Likewise, the device 10 according to the invention is advantageously integrated into a waterjet cutting machine 1 whose nozzle 5 is mobile relative to its frame 2.

Finally, it goes without saying that the examples of the device 10 according to the invention described above are only particular illustrations and are not limiting in any way.

The invention claimed is:

1. A device integrated into a waterjet cutting machine provided with at least one receiving tank and a nozzle movable above said receiving tank, said device being capable of catching a high-pressure water jet coming from said nozzle, the device comprising:

a receptacle/pipe assembly, comprising a receptacle arranged inside the receiving tank in line with said nozzle, and a flexible pipe assembly, a lower portion of the receptacle being connected to the flexible pipe assembly connected to a bottom of the receiving tank, the receptacle/pipe assembly being mobile and detachable from the receiving tank, a drive for supporting and moving at least part of the receptacle/pipe assembly including a driving member arranged outside the receiving tank and connected to the nozzle, and a driven member arranged inside the receiving tank and fixed to the receptacle, the drive being such that there is no mechanical connection between the driving member and the driven member, at least either the driving member or driven member including a magnet.

2. The device according to claim 1, wherein the driving member and driven member each include a magnet such that when the driving member moves at the same time as the nozzle the magnetic force of attraction of its magnet attracts the magnet of the driven member and causes the displacement of the latter and of the receptacle pipe assembly.

3. The device according to claim 1, wherein either the driving member or driven member includes a magnet while the other driven member or driving member includes a part made from a material that is attracted by said magnet.

4. The device according to claim 1, wherein the receptacle is in the form of a funnel.

5. The device according to claim 1, further comprising: a carriage fixed to the receptacle and cooperating with a guide profile fixed horizontally to one of the walls of the receiving tank, such that the receptacle/pipe assembly moves along said guide profile.

6. The device according to claim 5, wherein the carriage includes at least one roller.

7. The device according to claim 1, wherein the wall of the receiving tank and the associated guide profile each have a cross-section with a homothetic shape to that of the nozzle trajectory.

8. The device according to claim 7, wherein the guide profile is straight.

9. The device according to claim 7, wherein the guide profile is arcuate.

10. The device according to claim 1, wherein the pipe assembly is connected to the base of said receiving tank by means of a quick connect coupling that does not require any tool.

* * * * *